US010144029B2

(12) United States Patent
Lawyer et al.

(10) Patent No.: US 10,144,029 B2
(45) Date of Patent: Dec. 4, 2018

(54) FLEXIBLE AUXILIARY NOZZLE CARRIER

(75) Inventors: Jerry D. Lawyer, Clermont, FL (US); Donald E. Smith, Winter Springs, FL (US)

(73) Assignee: SENNINGER IRRIGATION, INC., San Marcos, CA (US)

( * ) Notice: Subject to any disclaimer, the term of this patent is extended or adjusted under 35 U.S.C. 154(b) by 607 days.

(21) Appl. No.: 13/591,432

(22) Filed: Aug. 22, 2012

(65) Prior Publication Data

US 2012/0312904 A1 Dec. 13, 2012

Related U.S. Application Data

(60) Division of application No. 12/653,963, filed on Dec. 22, 2009, which is a continuation-in-part of application No. 12/215,661, filed on Jun. 30, 2008, now Pat. No. 8,556,196.

(51) Int. Cl.

| | |
|---|---|
| ***B05B 15/65*** | (2018.01) |
| ***B05B 15/06*** | (2006.01) |
| *B05B 1/16* | (2006.01) |
| *B05B 1/26* | (2006.01) |
| *B05B 3/04* | (2006.01) |

(52) U.S. Cl.

CPC ..... *B05B 15/065* (2013.01); *B05B 15/65* (2018.02); *B05B 1/16* (2013.01); *B05B 1/262* (2013.01); *B05B 3/0486* (2013.01)

(58) Field of Classification Search

CPC ..... B05B 1/16; B05B 1/262; B05B 3/0486; B05B 15/065; B05B 15/65

USPC ..... 239/391–395, 397, 442, 600

See application file for complete search history.

(56) References Cited

U.S. PATENT DOCUMENTS

| | | | | |
|---|---|---|---|---|
| 502,796 | A * | 8/1893 | Watson | 239/395 |
| 3,799,453 | A | 3/1974 | Hart | |
| 5,234,169 | A | 8/1993 | McKenzie | |
| 5,524,829 | A * | 6/1996 | Keim | B05B 1/3006 137/853 |
| 5,699,962 | A | 12/1997 | Scott et al. | |
| 5,762,269 | A | 6/1998 | Sweet | |
| 6,676,038 | B2 | 1/2004 | Gressett et al. | |
| 6,871,795 | B2 | 3/2005 | Anuskiewicz | |

* cited by examiner

*Primary Examiner* — Christopher Kim

(74) *Attorney, Agent, or Firm* — Knobbe, Martens, Olson & Bear, LLP

(57) ABSTRACT

An irrigation sprinkler head has an auxiliary nozzle carrier having a nozzle attached to each end thereof. Each nozzle is held on one end of the flexible nozzle carrier. One end of the nozzle carrier holding a nozzle is attached to the sprinkler head to operatively attach the nozzle to the outlet of the sprinkler head while the other end extends from the side of the sprinkler head. The nozzles are rapidly exchanged on the sprinkler head by disconnecting the nozzle carrier and nozzle from the sprinkler head and connecting the other end of the nozzle carrier and nozzle to the sprinkler head without removing either nozzle from the carrier and without the use of tools. The nozzle carrier is flexible and angled between the nozzle holding ends so that the nozzle carrier can flex between the ends thereof to absorb impact without damage when used below a crop line.

18 Claims, 3 Drawing Sheets

FLEXIBLE AUXILIARY NOZZLE CARRIER

This application is a division of prior U.S. patent application Ser. No. 12/653,963, filed Dec. 22, 2009 for Flexible Auxiliary Nozzle Carrier, which is a continuation-in-part of prior U.S. patent application Ser. No. 12/215,661, filed Jun. 30, 2008 for a Quick Change Nozzle.

BACKGROUND OF THE INVENTION

The present invention relates to an irrigation sprinkler head flexible auxiliary nozzle carrier for supporting a plurality of nozzles held on a sprinkler head by one of the nozzles being operatively attached to the sprinkler head. The nozzle carrier is flexible and resilient between the ends thereof and absorbs impact without damage allowing the sprinkler head to be used below a crop line.

A variety of irrigation systems are used throughout the world or irrigating crops and groves. One common system used for irrigation is a sprinkler system having a plurality of sprinkler heads coming from a central water supply line for distributing water over a surface area. These systems may use a moving supply line for irrigating food crops, groves and the like. The sprinkler units typically have replaceable nozzles so that different nozzles may be selected and mounted in the sprinkler unit to achieve a desired range or rate of coverage or simply to replace a defective nozzle. An irrigation system may also have many different sprinkler units of the same type with each having different nozzles and it is sometimes desirable and necessary to change the nozzles often for a given area to obtain an optimum irrigation of an area of coverage. This requires maintaining different sprinkler nozzles and selecting the nozzle for a particular coverage after a sprinkler system is installed. Many current nozzles are removably attached to a sprinkler head in which the nozzle or a cover for the nozzle is threadedly attached which requires unscrewing a nozzle or cap for the nozzle, finding a replaceable nozzle, and attaching the new nozzles onto the sprinkler unit. This is sometimes difficult because the nozzle is positioned so it cannot be gripped easily to unscrew the nozzle or to simply pull out the nozzle in the case of a press-fitted nozzle. It is also necessary to have a replacement nozzle handy for exchanging nozzles on the sprinkler head.

In Applicant's prior U.S. patent application Ser. No. 12/215,661, filed Jun. 30, 2008, for a Quick Change Nozzle an irrigation sprinkler has a rapid change nozzle which can be snapped-in from the side of the sprinkler outlet and then quickly unsnapped and removed.

Other prior art removable sprinkler nozzles may be seen in the McKenzie U.S. Pat. No. 5,234,169 for a removable sprinkler nozzle in which the nozzle fits in a recessed seat and has a rotatable upper cover and a camming surface formed on the cover which extends down into engagement with the nozzle. The cam surface is shaped to push the nozzle at least partially out of its seat during rotation of the cover to allow a user to be able to grip the nozzle and complete its removal by pulling outward on the nozzle. The cover also includes a locking rib which can be brought to bear against the nozzle when the nozzle is fully received in its seat to help retain the nozzle in place. In the Scott et al. U.S. Pat. No. 5,699,962, a sprinkler unit has a nozzle in which the sprinkler body has an outlet having a nozzle receiving socket for a removable nozzle mounted in the sprinkler outlet. The lodging device in the socket is used for latching engagement with the nozzle for retaining the nozzle in the socket. In the Hart U.S. Pat. No. 3,799,453, a quick disconnect nozzle for an irrigation sprinkler is fitted with a screw threaded connection to the sprinkler outlet. The Anuskiewicz U.S. Pat. No. 6,871,795 is an irrigation sprinkler with an easily removable nozzle.

The present invention relates to an irrigation sprinkler system in which a nozzle attached to a sprinkler head needs to be exchanged for another size nozzle at some time during the growing season. In a typical irrigation system sprinkler heads with one or more auxiliary nozzles, the sprinkler head carries two or more nozzles in a rigid nozzle carrier. While one nozzle in the carrier is being utilized by the sprinkler, an alternate nozzle is held off to the side, out of the water spray. To change the nozzle, the nozzle that was being used is removed from the sprinkler, the nozzle carrier is flipped around and a new nozzle is installed into the sprinkler. The nozzle is held off to the side, out of the spray, but the nozzle and carrier are vulnerable to damage.

Sprinklers mounted on flexible drops from a central water line are also prone to blowing around in high winds. This random movement allows the sprinklers to impact one another and the support structure itself. If the alternate nozzle or the nozzle carrier is struck, the nozzle and/or nozzle carrier can get damaged or broken off and lost. In addition these sprinklers are often dragged through taller crops and if the carrier gets hooked on a plant, it will break the carrier and the alternate nozzle will be lost. Sprinklers can also be dragged along the ground when a field has high and low spots. If a rigid carrier and nozzle system impacts something hard or gets hooked on a plant and pulled, the sprinkler itself can be unscrewed and lost.

The present invention prevents damage to the carrier, loss of the alternate nozzle(s) and the unwanted unscrewing of the sprinkler. The flexible carrier prevents damage to the nozzle carrier itself and reduces the chance that the working nozzle will become dislodged by impact or contact with other sprinklers, center pivot structures, or crops.

One prior art auxiliary nozzle holder can be seen in U.S. Pat. No. 5,762,269, to Sweet, for a Nozzle Clip. The nozzle clip holds two nozzles, one of which is connected to an adapter on the sprinkler head for receiving a quick change nozzle. The clip is reversible such that the first and second nozzles are selectively mounted on the adapter.

The present invention relates to an auxiliary nozzle carrier for carrying an extra sprinkler nozzle for an irrigation sprinkler capable of absorbing impact without damage while being able to deflect away from obstacles rather than becoming damaged by them.

SUMMARY OF THE INVENTION

An auxiliary nozzle carrier is provided for a sprinkler head for holding a second or plurality of nozzles to the sprinkler head. The auxiliary nozzle carrier can hold any number of nozzles desired. The nozzle carrier body has two end portions spaced by a generally stepped or offset center portion. Each end portion has means for attaching a nozzle thereto. The generally stepped or offset center portion is flexible and resilient so that an attached nozzle or nozzles can move relative to another attached nozzle so that contact with one nozzle flexes the nozzle carrier to prevent damage to the nozzle carrier or other nozzle. Each nozzle is held to one end portion of the nozzle carrier by a specially shaped opening or window for retaining the nozzle. The nozzle carrier may be made of an elastomer or rubber or may be a living hinge.

A sprinkler having an auxiliary nozzle carrier and two or more nozzles each having a sprinkler housing having a housing passageway therethrough having an inlet for connecting to a source of water and an outlet therefrom. The sprinkler head may have an outlet having a side window for inserting a rapid change nozzle from the side of the housing passageway. The auxiliary nozzle carrier has two end portions, with each end portion being offset from the other end portion and each end portion having a nozzle attached thereto. Each nozzle has a nozzle passageway therethrough, and is attached to the housing to axially align the housing passageway and with a nozzle passageway. Each nozzle has attaching means for removably attaching the nozzle to the housing. Any one of the nozzles attached to the auxiliary nozzle carrier can be attached to the sprinkler housing while holding the other nozzle or nozzles in the auxiliary nozzle carrier to the sprinkler. One nozzle can be rapidly exchanged with another nozzle on the sprinkler head by disconnecting one from the sprinkler head, and connecting the other to the sprinkler without removing a nozzle from said nozzle carrier.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
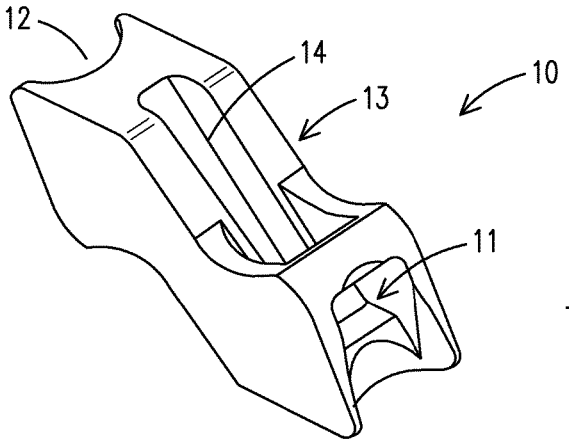
FIG. 1 is a perspective view of an auxiliary nozzle carrier in accordance with the present invention.
Figure 2:
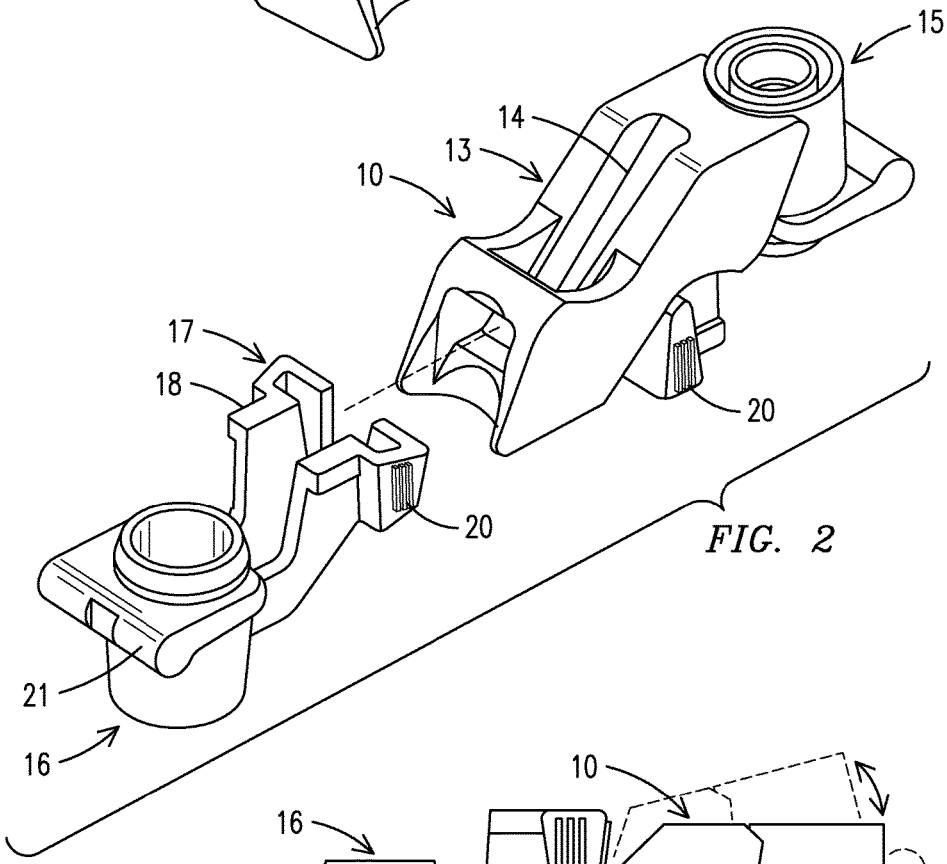
FIG. 2 is an exploded perspective view of auxiliary nozzle carrier of FIG. 1 having a nozzle being attached thereto.

The present invention relates to an irrigation sprinkler head flexible auxiliary nozzle carrier for supporting two or more nozzles held on a sprinkler head by one of the nozzles being operatively attached to the sprinkler head.

Referring to the drawings FIGS. 1 through 4, a flexible nozzle carrier 10 can be seen having openings or passageways 11 and 12. The openings are identical except for one being upside down from the other. The carrier has an offset or stepped and angled flexible area 13 between the ends thereof which has an enlarged groove 14. The flexible nozzle carrier 10 has a nozzle 15 mounted in one end thereof and a nozzle 16 mounted in the other end thereof. The nozzles 15 and 16 can be seen to be mounted upside down from each other.

Each nozzle has a pair of latching arms 17 having a pair of snap tabs 18, which arms have been inserted through the carrier 10 opening 11 for one nozzle and the opening 12 for the other nozzle. Each handle section has a gripping portion 20 so that the arms 17 protruding through the openings 11 and 12 in the nozzle carrier 10 may be squeezed together. Each nozzle 15 and 16 has a tongue 21 protruding therefrom used for mounting the nozzle to a sprinkler head. The offset or stepped area 13 advantageously places the auxiliary nozzle out of the way of the water spray from the sprinkler head by the angle of the offset area 13 set to raise the level of the auxiliary nozzle. It should, however, be clear that any other type of nozzle, such as a threadedly attached nozzle can be supported on the auxiliary nozzle without departing from the spirit and scope of the invention.

Figure 4:
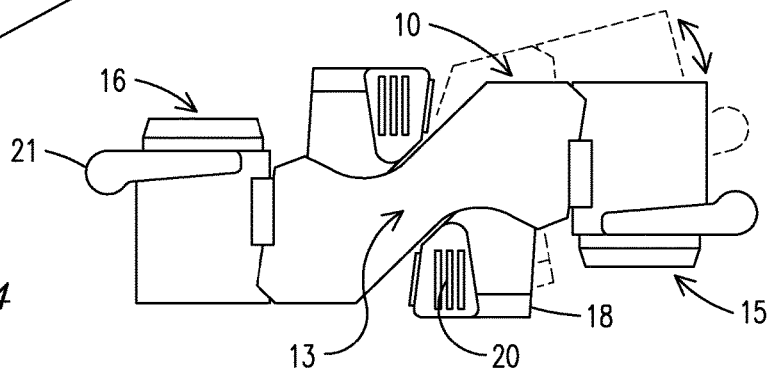
FIG. 4 is a side elevation of the auxiliary nozzle carrier of FIG. 3 showing the flexing thereof in phantom.
Figure 3:
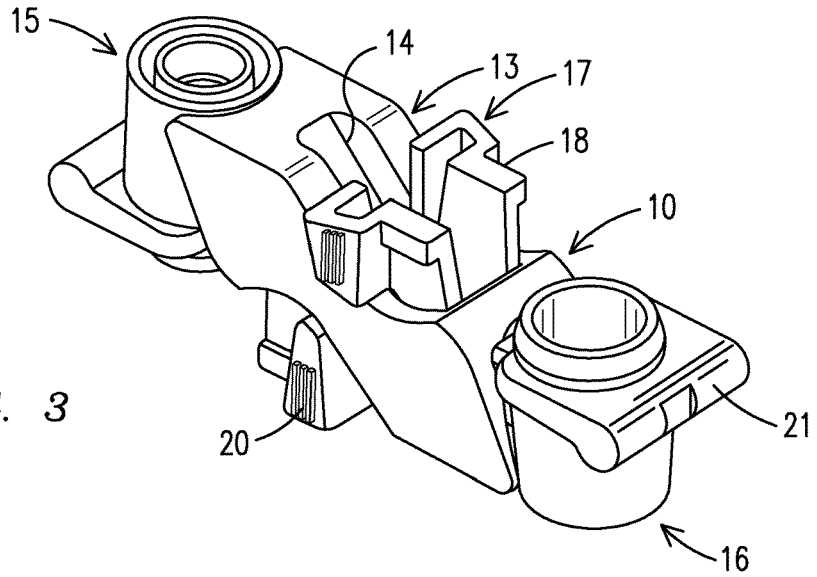
FIG. 3 is a perspective view of the auxiliary nozzle carrier of FIGS. 1 and 2 having a pair of nozzles attached thereto.
Figure 5:
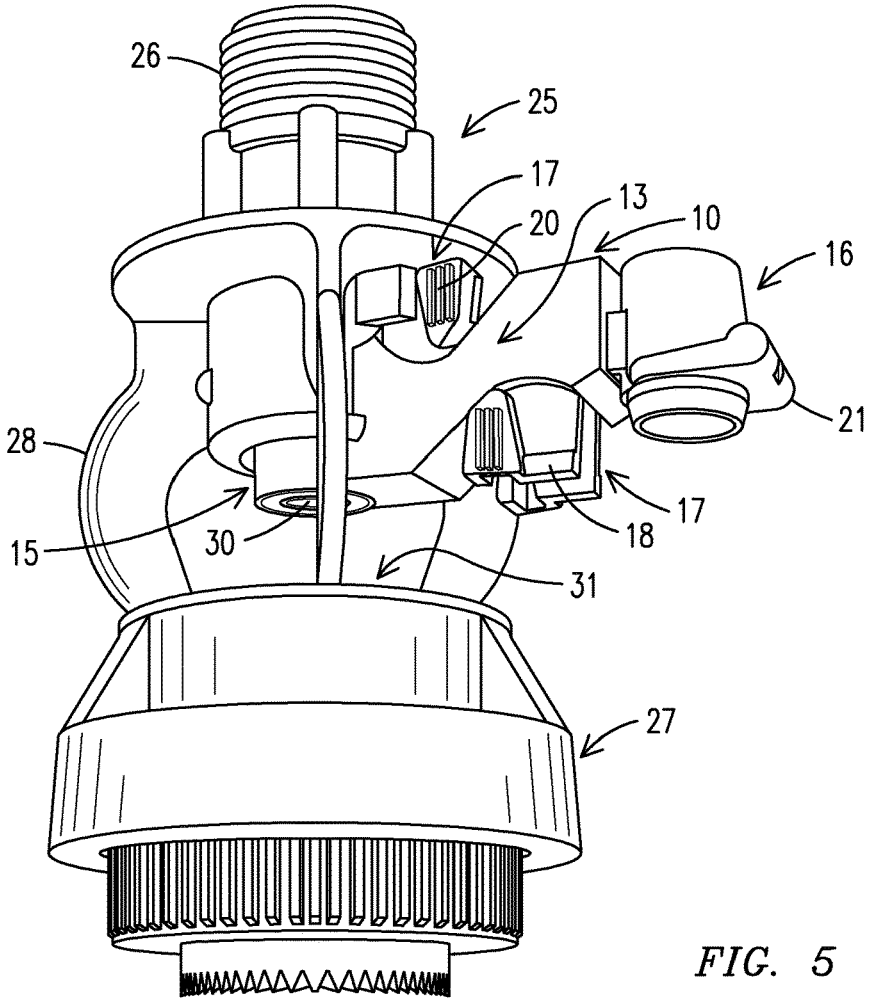
FIG. 5 is a perspective view of an irrigation sprinkler head having the auxiliary nozzle carrier supporting an auxiliary nozzle.

As seen in FIG. 4, a sprinkler head 25 has a threaded connector 26 for attaching to a water source for water to pass through the sprinkler head 25. The sprinkler head 25 has a water dispersion portion 27 supported by a plurality of arms 28 and has a nozzle 15 mounted therein and supporting a flexible nozzle carrier 10 supporting an auxiliary nozzle 16 on the opposite end of the nozzle carrier 10 from the nozzle 15. The nozzle carrier 10 is made of a flexible and resilient material or can be made with a living hinge to allow flexibility to the stepped or angled portion 13 of the carrier 10. This allows the flexible nozzle carrier 10 to flex if something hits the auxiliary nozzle 16 in FIG. 5 causing it to flex, as shown in the phantom view in FIG. 4. This prevents the auxiliary nozzle 15 from being damaged when struck by an object and, at the same time, prevents the nozzle 15 from being knocked loose from the sprinkler head 25.

The sprinkler head 25 can be dragged through tall crops where it is constantly being hooked on other plants where the nozzle 15 auxiliary nozzle 16 can be knocked loose from a carrier. The sprinkler can also be dragged along the ground when the field has high and low spots without the auxiliary nozzle being knocked loose or the nozzle being knocked from the sprinkler head. In addition, sprinklers mounted on flexible drops on center pivot supply lines and the like are prone to blowing around in high winds and randomly impact one against another. The present auxiliary nozzle carrier will flex whenever the auxiliary nozzle catches on a plant or is struck by an object or another sprinkler.

The angled offset flexible center portion of the carrier 10 is angled to raise the auxiliary nozzle above the water being sprayed or distributed by the sprinkler head 25 as the water passes through the opening 30 of the nozzle 15 and impinges upon the water distribution surface 31. The nozzle carrier 10 can be made of any strong flexible material, such as rubber or a flexible elastomer.

Figure 6:
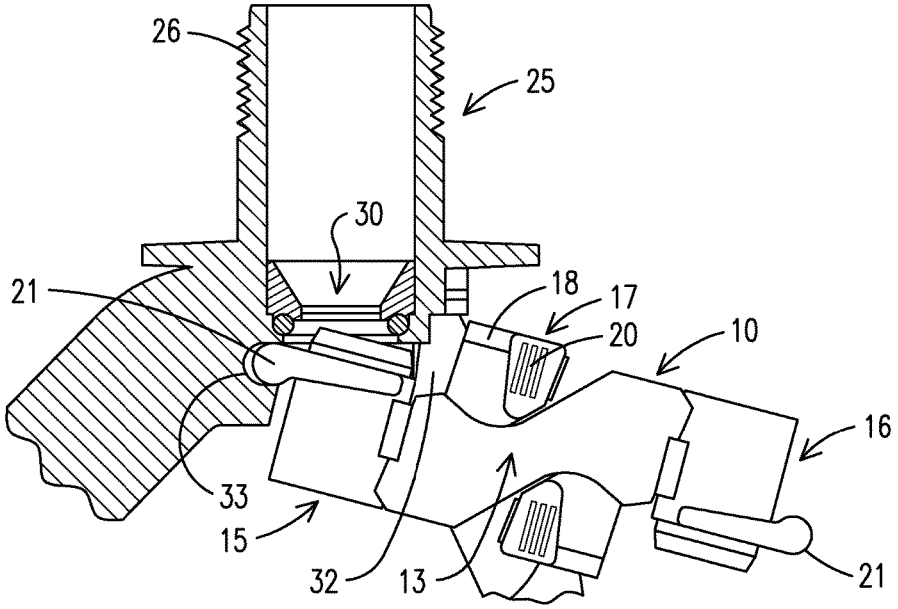
FIG. 6 is a partial sectional view of a sprinkler head having a nozzle supported on the nozzle carrier being attached thereto.
Figure 7:
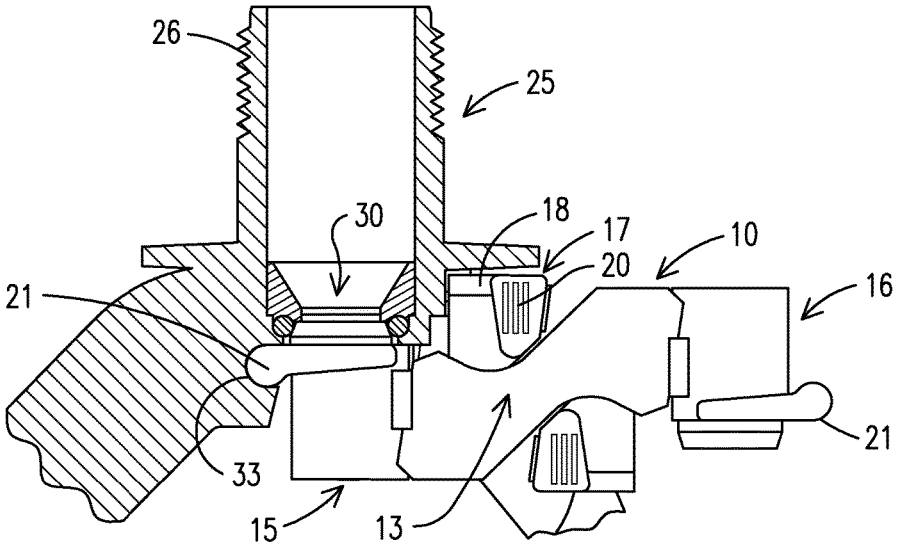
FIG. 7 is a partial sectional view of the sprinkler head of FIG. 6 having a nozzle and nozzle carrier and auxiliary nozzle mounted therein.

The mounting of a nozzle having the auxiliary nozzle carrier attached is seen in FIGS. 6 and 7. The water outlet 30 of the nozzle sprinkler body 25 has a side opening or window 32 for inserting the nozzle 15. The sprinkler head 25 has a recessed area 33 on the opposite side of the body from the window 32. Latching members 34 are formed on the sprinkler body 25 adjacent to and above the side window 32. The tongue 21 may be of a rounded shape and is sized to fit in the recessed area 33 of the sprinkler head body. The pair of arms 17 on the nozzle 15 has a pair of snap connectors or latching members 18 for engaging the sprinkler body latching members 34.

In operation, the nozzle 15, as seen in FIGS. 6 and 7, can be grasped by handles 20 on the arms 17 for inserting the nozzle 15 through the side window 32 and the tongue 21 inserted into the recess 33 of the sprinkler head allowing the nozzle 15 to be rotated with a lever action on the tongue 21 in the recess 33. Arms 17 are pressed together to move a pair of snap tabs 18 inward towards each other where they can be snapped into position so that when the handles are released, the nozzle is locked in place, aligning the passageway of nozzle 15 with the outlet of the sprinkler head 25. The nozzle arms 17 are squeezed together for disengaging the latching mechanism for nozzle removal.

It should be clear at this time that an auxiliary nozzle carrier for an irrigation sprinkler has been provided which is capable of absorbing impact without damage and which is able to deflect away from obstacles to avoid damage. The auxiliary nozzle carrier is both flexible and tear resistant. However, the present invention is not to be construed as limited to the forms shown which is to be considered illustrative rather than restrictive.

We claim:

1. A sprinkler comprising:

a sprinkler housing having a housing passageway therethrough having:

an inlet for connecting to a source of water, and an outlet therefrom, said outlet having a housing side window for inserting a nozzle from the side of said housing passageway; and an auxiliary nozzle carrier having:

an offset flexible center portion, and two end portions, a first end portion being at a first end of said offset flexible center portion and having a first nozzle mounted thereto, and a second end portion at a second end of said offset flexible center portion and having an auxiliary nozzle mounted thereto, said offset flexible center portion having an angle set to raise a level of the auxiliary nozzle from a level of the first nozzle, the offset flexible center portion configured to allow flexing thereof and movement of the second end portion relative to said sprinkler housing and to place the auxiliary nozzle out of the way by the angle when the first nozzle is attached to said sprinkler housing, each of said first and auxiliary nozzles having a nozzle passageway therethrough, and being shaped to fit through said housing side window and axially aligned with said housing passageway;

wherein the first nozzle has a first pair of latching arms that is configured to attach the first nozzle to the outlet of the sprinkler housing and the auxiliary nozzle has a second pair of latching arms that is configured to attach the auxiliary nozzle to the outlet of the sprinkler housing;

wherein each arm of each of the first and second pairs of latching arms has a snap tab;

whereby said auxiliary nozzle carrier can have said first nozzle attached in said sprinkler housing while flexibly holding said auxiliary nozzle therein adjacent said sprinkler housing to absorb impact without damaging said auxiliary nozzle;

wherein each of the two end portions of the auxiliary nozzle carrier includes an opening for removably attaching one of said first and auxiliary nozzles; and wherein the offset flexible center portion is configured to flex when the auxiliary nozzle carrier catches on a plant or is struck by an object or by another sprinkler.

2. The sprinkler in accordance with claim 1 wherein said auxiliary nozzle carrier has a living hinge between the two end portions thereof.

3. The sprinkler in accordance with claim 1 wherein the first nozzle comprises two deflectable tabs configured to engage a portion of the sprinkler housing when the first nozzle is attached in the sprinkler housing.

4. The sprinkler in accordance with claim 1 wherein the offset flexible center portion comprises an elastomer.

5. The sprinkler in accordance with claim 1 further comprising at least one arm permanently connected to the sprinkler housing and extending past the outlet away from the inlet.

6. The sprinkler in accordance with claim 5 further comprising a water dispersion portion connected to the at least one arm downstream of the outlet of the sprinkler housing.

7. The sprinkler in accordance with claim 1 wherein each of the pairs of snap tabs is configured to engage a portion of the sprinkler housing.

8. The sprinkler in accordance with claim 1 wherein the offset flexible center portion of the auxiliary nozzle carrier is configured to set the auxiliary nozzle out of the way of water spray when the first nozzle is attached to said sprinkler housing and water is passing through the inlet.

9. The sprinkler in accordance with claim 1 wherein the first nozzle further comprises a tongue configured to permit the first nozzle to rotate when the first nozzle is attached to said sprinkler housing.

10. A sprinkler comprising:

a sprinkler body having:

a housing passageway;

an inlet end;

an outlet end; and a side window between the inlet end and the outlet end for inserting a nozzle from the side of said housing passageway;

at least one arm permanently connected to the sprinkler body and extending past the outlet end away from the inlet end;

a water dispersion portion connected to the at least one arm downstream of the outlet end of the sprinkler body;

a nozzle carrier having:

a first end;

a second end;

an offset flexible central portion constructed from an elastomer and extending between the first and second ends, said offset flexible center portion having an angle set to displace a level of said second end from a level of said first end;

a first opening in the first end; and a second opening in the second end;

a first nozzle having:

a nozzle body having a nozzle inlet and a nozzle outlet; and a pair of latching arms connected to the nozzle body and configured to pass through the first opening in the first end of the nozzle carrier to releasably connect the first nozzle to the first end of the nozzle carrier; and a second nozzle having:

a nozzle body having a nozzle inlet and a nozzle outlet; and a pair of latching arms connected to the nozzle body and configured to pass through the second opening in the second end of the nozzle carrier to releasably connect the second nozzle to the second end of the nozzle carrier;

wherein the pair of latching arms of the first nozzle is further configured to attach the first nozzle to the outlet end of the sprinkler body;

wherein the pair of latching arms of the second nozzle is further configured to attach the second nozzle to the outlet end of the sprinkler body;

wherein each arm of each pair of latching arms of the first and second nozzles has a snap tab;

wherein said offset flexible center portion of the nozzle carrier is configured to displace a level of the second nozzle from a level of the first nozzle by the angle; and wherein the offset flexible central portion of the nozzle carrier is configured to flex when the nozzle carrier catches on a plant or is struck by an object or by another sprinkler.

11. The sprinkler in accordance with claim 10 wherein the pair of latching arms of the first nozzle comprises a first arm connected to the nozzle body and a second arm connected to the nozzle body, wherein each of the first and second arms are configured to deflect toward each other as the first nozzle is releasably connected to the first end of the nozzle carrier.

12. The sprinkler in accordance with claim 11 wherein the first and second arms of the first nozzle are configured to deflect toward each other as the first nozzle is attached to the outlet end of the sprinkler body.

13. The sprinkler in accordance with claim 12 wherein the pair of latching arms of the second nozzle is structurally identical to the pair of latching arms of the first nozzle.

14. A sprinkler comprising:

a sprinkler body having:

a housing passageway;

an inlet end;

an outlet end; and a side window between the inlet end and the outlet end for inserting a nozzle from the side of said housing passageway;

a nozzle carrier having:

a first end;

a second end;

an offset flexible central portion constructed from an elastomer and extending between the first and second ends, said offset center portion having an angle set to displace a level of said second end from a level of said first end;

a first opening in the first end; and a second opening in the second end;

a first nozzle having:

a nozzle body having a nozzle axis, a nozzle inlet, and a nozzle outlet; and a pair of latching arms connected to the nozzle body and configured to releasably connect the first nozzle to the first end of the nozzle carrier; and a second nozzle having:

a nozzle body having a nozzle axis, a nozzle inlet, and a nozzle outlet; and a pair of latching arms connected to the nozzle body and configured to releasably connect the second nozzle to the second end of the nozzle carrier;

wherein the pair of latching arms of the first nozzle is configured to attach the first nozzle to the outlet end of the sprinkler body;

wherein the pair of latching arms of the second nozzle is configured to attach the second nozzle to the outlet end of the sprinkler body;

wherein each arm of each pair of latching arms of the first and second nozzles has a snap tab;

wherein said offset flexible center portion is configured to displace a level of the second nozzle from a level of the first nozzle by the angle; and wherein the offset flexible central portion of the nozzle carrier is configured to flex when the auxiliary nozzle carrier catches on a plant or is struck by an object or by another sprinkler.

15. The sprinkler in accordance with claim 14 wherein the nozzle outlet of the first nozzle does not extend beyond the first end of the nozzle carrier in a direction parallel to the nozzle axis of the first nozzle when the first nozzle is releasably attached to the nozzle carrier.

16. The sprinkler in accordance with claim 15 wherein the nozzle outlet of the second nozzle does not extend beyond the second end of the nozzle carrier in a direction parallel to the nozzle axis of the second nozzle when the second nozzle is releasably attached to the nozzle carrier.

17. The sprinkler in accordance with claim 15 wherein the nozzle inlet of the first nozzle does not extend beyond the second end of the nozzle carrier in a direction parallel to the nozzle axis of the first nozzle when the first nozzle is releasably attached to the nozzle carrier.

18. The sprinkler in accordance with claim 14 further comprising an O-ring positioned within the sprinkler body, wherein nozzle inlet of the first nozzle is tapered and configured to contact the O-ring to form a seal between the O-ring and the nozzle inlet when the first nozzle is attached to the outlet end of the sprinkler body.

* * * * *